US006916151B2

(12) United States Patent
Judet et al.

(10) Patent No.: US 6,916,151 B2
(45) Date of Patent: Jul. 12, 2005

(54) VENTILATION DEVICE FOR A HIGH PRESSURE TURBINE ROTOR OF A TURBOMACHINE

(75) Inventors: Maurice Judet, Dammarie les Lys (FR); Patrick Rossi, Asnieres sur Seine (FR); Jean-Claude Taillant, Vaux le Penil (FR)

(73) Assignee: SNECMA Moteurs, Paris (FR)

( * ) Notice: Subject to any disclaimer, the term of this patent is extended or adjusted under 35 U.S.C. 154(b) by 0 days.

(21) Appl. No.: 10/771,540

(22) Filed: Feb. 5, 2004

(65) Prior Publication Data

US 2004/0219008 A1 Nov. 4, 2004

(30) Foreign Application Priority Data

Feb. 6, 2003 (FR) ..... 03 01391

(51) Int. Cl.[7] ..... F01D 5/18

(52) U.S. Cl. ..... 415/115; 415/116; 415/117; 415/173.7; 415/174.5; 60/806

(58) Field of Search ..... 415/115, 116, 415/117, 173.7, 174.5, 230; 60/782, 785, 806

(56) References Cited

U.S. PATENT DOCUMENTS 3,043,561 A 7/1962 Scheper, Jr.
4,425,079 A * 1/1984 Speak et al. ..... 415/115
4,462,204 A * 7/1984 Hull ..... 60/806
4,882,902 A 11/1989 Reigel et al.
5,555,721 A * 9/1996 Bourneuf et al. ..... 60/806
5,586,860 A 12/1996 Bertrand et al.
6,468,032 B2 * 10/2002 Patel ..... 415/115
6,540,477 B2 * 4/2003 Glynn et al. ..... 415/115
6,735,956 B2 * 5/2004 Romani ..... 60/806

FOREIGN PATENT DOCUMENTS

| | | |
|---|---|---|
| DE | 198 54 907 | 5/2000 |
| FR | 2 598 179 | 11/1987 |
| FR | 2 712 029 | 5/1995 |

* cited by examiner

*Primary Examiner*—Christopher Verdier
(74) *Attorney, Agent, or Firm*—Oblon, Spivak, McClelland, Maier & Neustadt, P.C.

(57) ABSTRACT

A ventilation device for a high pressure turbine rotor in a turbomachine, the turbine comprising upstream and downstream turbine disks fitted with blades, the device comprising a cooling circuit being supplied by a cooling airflow D taken from the back of the combustion chamber. The circuit is such that the airflow passes through orifices formed in an upstream flange of the upstream disk, such that this airflow circulates in the axial direction towards the downstream side between an inner reaming of the upstream disk and a downstream flange of the downstream disk, the device also comprising a labyrinth inserted between the two disks, such that the airflow is divided into a first flow F1 and a second flow circulating on each side of labyrinth towards the blades.

4 Claims, 2 Drawing Sheets

VENTILATION DEVICE FOR A HIGH PRESSURE TURBINE ROTOR OF A TURBOMACHINE

TECHNICAL FIELD

This invention relates in general to the ventilation of a high pressure turbine rotor in a turbomachine.

More precisely, the invention relates to a ventilation device for a high pressure turbine rotor comprising an upstream turbine disk and a downstream turbine disk.

STATE OF PRIOR ART

FIG. 1 shows a conventional high pressure turbine rotor 1 according to prior art, arranged on the downstream side of a combustion chamber 2, and comprising an upstream turbine disk 3 equipped with blades 4, and a downstream turbine disk 5 equipped with blades 6.

The upstream disk 3 is provided firstly with an upstream flange 8 that attaches it to a spacer 9 arranged around a rotor shaft 11 of a low pressure turbine, and secondly a downstream flange 10 rigidly assembled to an upstream flange 12 of the downstream disk 5. Note that there is an inter-disk seal 14, supported by a hollow structure 16 fixed to a fixed distributor stage 18 or stator, at the assembly between the two flanges 10 and 12. The labyrinth seal type of inter-disk seal 14 creates a separation between the two rotor stages 20 and 22 arranged on each side of the distributor stage 18.

Furthermore, the downstream disk 5 comprises a downstream flange 13, that is also assembled on the spacer 9 surrounding the shaft 11 of the low pressure turbine.

In this type of conventional turbine 1 according to prior art, a first cooling airflow D1 taken from the back of the combustion chamber 2 is output into a cavity 26 delimited firstly by a downstream face of an upstream labyrinth 24 located close to the upstream disk 3, and secondly by an upstream face of the same upstream disk 3. This airflow D1 is actually taken from the back of the combustion chamber 2 and is then transferred into a cavity 30, delimited particularly by an upstream labyrinth seal 32 and a downstream labyrinth seal 34, through a duct 28 arranged in a chamber 29 separating the upstream labyrinth 24 from the back of the combustion chamber 2, and using injectors 36 arranged along the extension of the duct 28 and opening up in the cavity 30. Note that the seals 32 and 34 are arranged so as to be in contact with the upstream labyrinth 24.

Moreover, cooling air in the cavity 30 can penetrate into the cavity 26 through orifices 38 provided in an upstream part of the upstream labyrinth 24, these orifices 38 being aligned approximately perpendicular to the longitudinal axis 40 of the turbine.

In this way, the cooling airflow D1 circulates in the cavity 26 firstly longitudinally and then radially towards the outside along the upstream face of the upstream labyrinth 24 in order to cool it, and then enters the compartments 4*a* containing the roots of the blades 4 in order to cool the blades.

Furthermore, a second cooling airflow D2, also taken from the back of the combustion chamber 2, enters the chamber 29 and flows through the orifices 44 and 42 provided in the upstream part of the upstream labyrinth 24, and in the downstream flange 8 of the upstream disk 3, respectively. After the second cooling airflow D2 has passed through the orifices 44 and 42, it passes through an annular chamber 46 delimited on the inside by the spacer 9, and on the outside (working in order from the upstream side to the downstream side), the flange 8, an inner reaming 48 in the upstream disk 3, flanges 10 and 12, an inner reaming 50 in the downstream disk 5, and the flange 13.

Starting from the annular chamber 46, a first part D2*a* of the second cooling airflow D2 flows through orifices 52 formed in the downstream flange 10 of the upstream disk 3, in order to join the interstice 19 located between the fixed distributor stage 18 and the rotor stage 20, as shown diagrammatically by the arrow reference D2*a*. For information, note that the airflow d diagrammatically represented in FIG. 1 corresponds to an air leak at the compartments 4*a*.

Moreover, a second part D2*b* of the second cooling airflow D2 flows through the orifices 54 formed in the downstream flange 13 of the downstream disk 5, to enter a cavity 56 delimited firstly by an upstream face of a downstream labyrinth 58 located close to the downstream disk 5, and secondly by a downstream face of the same downstream disk 5.

Thus, the second cooling airflow D2*b* circulates approximately radially in the cavity 56 towards the outside along the downstream face of the downstream labyrinth 58 in order to cool it, and then enters the compartments 6*a* containing the roots of the blades 6 in order to also cool the blades.

Therefore in this type of conventional turbine according to prior art, the rotor ventilation device possesses two separate cooling circuits, each associated with one of the two turbine disks and supplied by the first and second cooling airflows D1 and D2 respectively.

Nevertheless, this conventional solution according to prior art is constraining in the sense that the design of the upstream labyrinth is extremely complex, heavy and its production cost is very high, particularly due to the need to use special materials capable of resisting high intensity thermal loads.

Moreover, the life of the upstream labyrinth is relatively limited even when good quality materials are used.

SUMMARY OF THE INVENTION

Therefore, the purpose of the invention is to propose a ventilation device for a high pressure turbine rotor in a turbomachine, the turbine being placed on the downstream of a combustion chamber and comprising upstream and downstream turbine disks fitted with blades, the device comprising a cooling circuit fitted with injectors located on the upstream of the upstream disk and being supplied by a cooling airflow D taken from the back of the combustion chamber, the device at least partially overcoming the disadvantages mentioned above related to embodiments according to prior art.

To achieve this, the purpose of the invention is a device for ventilation of a high pressure turbine rotor in a turbomachine, the turbine being placed on the downstream side of a combustion chamber and comprising an upstream turbine disk fitted with blades and a downstream turbine disk also fitted with blades, the device comprising a cooling circuit provided with injectors arranged on the upstream side of the upstream disk, the circuit being supplied by a cooling airflow D taken from the back of the combustion chamber. According to the invention, the cooling circuit is arranged so that the cooling airflow D originating from the injectors passes through orifices formed in an upstream flange of the upstream disk so that it can be fixed onto an upstream flange of the downstream disk, such that the cooling airflow D circulates in the axial direction towards the downstream side between an inner reaming of the upstream disk and an upstream flange on the downstream disk used to attach it onto a flange on the downstream side of a high pressure compressor and centering of the upstream disk, the ventilation device also comprising a single labyrinth fixed to one of the two turbine disks and being inserted between these two disks, such that the cooling airflow D is divided into a first flow F1 circulating between a downstream face of the upstream disk and an upstream face of the single labyrinth towards the blades on the upstream disk, and into a second flow F2 circulating between an upstream face of the downstream disk and a downstream face of the single labyrinth towards the downstream disk blades.

Advantageously, and unlike embodiments according to prior art, the ventilation device no longer comprises two labyrinths, one associated with the upstream turbine disk and one associated with the downstream turbine disk, but instead is provided with a single inter-disk labyrinth in which each of the upstream and downstream faces is designed to guide a cooling airflow towards the blades. Consequently, the reduction in the number of parts used considerably reduces the mass, size and production cost of the rotor. Furthermore, the specific position of the single labyrinth means that the thermal loads on this labyrinth are lower than for a labyrinth arranged on the upstream side of the upstream disk, mainly due to its position with respect to the combustion chamber, and to the extent that the temperature of the cooling airflow D drops significantly as it passes into the inner reaming of the upstream disk. This characteristic thus increases the life of this labyrinth, making it longer than the potential life of an upstream labyrinth according to prior art.

Furthermore, note that the pressure obtained at the blades of the upstream disk is sufficient due to the injection of cooling air on the upstream side of the upstream disk, the by-pass of this upstream disk through the inner reaming, and the possibility of making small rotor components, due to a single cavity delimited jointly by a downstream face of the upstream disk and an upstream face of the single labyrinth.

In this respect, the adjacent cavity delimited jointly by an upstream face of the downstream disk and by a downstream face of the single labyrinth is advantageously used to reduce the supply pressure to blades on the downstream disk. The low pressure inside this adjacent cavity means that there is no need to provide excessively small sized blade supply holes, which are difficult to make.

Advantageously, the rotor is made more compact due to the reduction in the number of component elements of the rotor and enables the bearing under the chamber to be brought closer to the upstream and downstream disks, such that better control of the clearances at the tip of the blades can be obtained, resulting in a better efficiency of the high pressure turbine.

Note also that the cooling airflow D passing through the inner reaming of the upstream turbine disk is sufficiently high for it to have a relatively low response time, and therefore a lower clearance can be provided at the tip of the blades.

Finally, this arrangement according to the invention enables fast and easy disassembly of the stator, to the extent that this task only requires removal of the blades from the downstream turbine disk without needing to dissociate the two rotor disks, although this operation is always compulsory in embodiments according to prior art.

Other advantages and specific features of the invention will become clearer after reading the detailed and non-limitative description given below.

BRIEF DESCRIPTION OF THE DRAWINGS

This description will be made with reference to the attached drawings among which.

DETAILED PRESENTATION OF PREFERRED EMBODIMENTS

Figure 1:
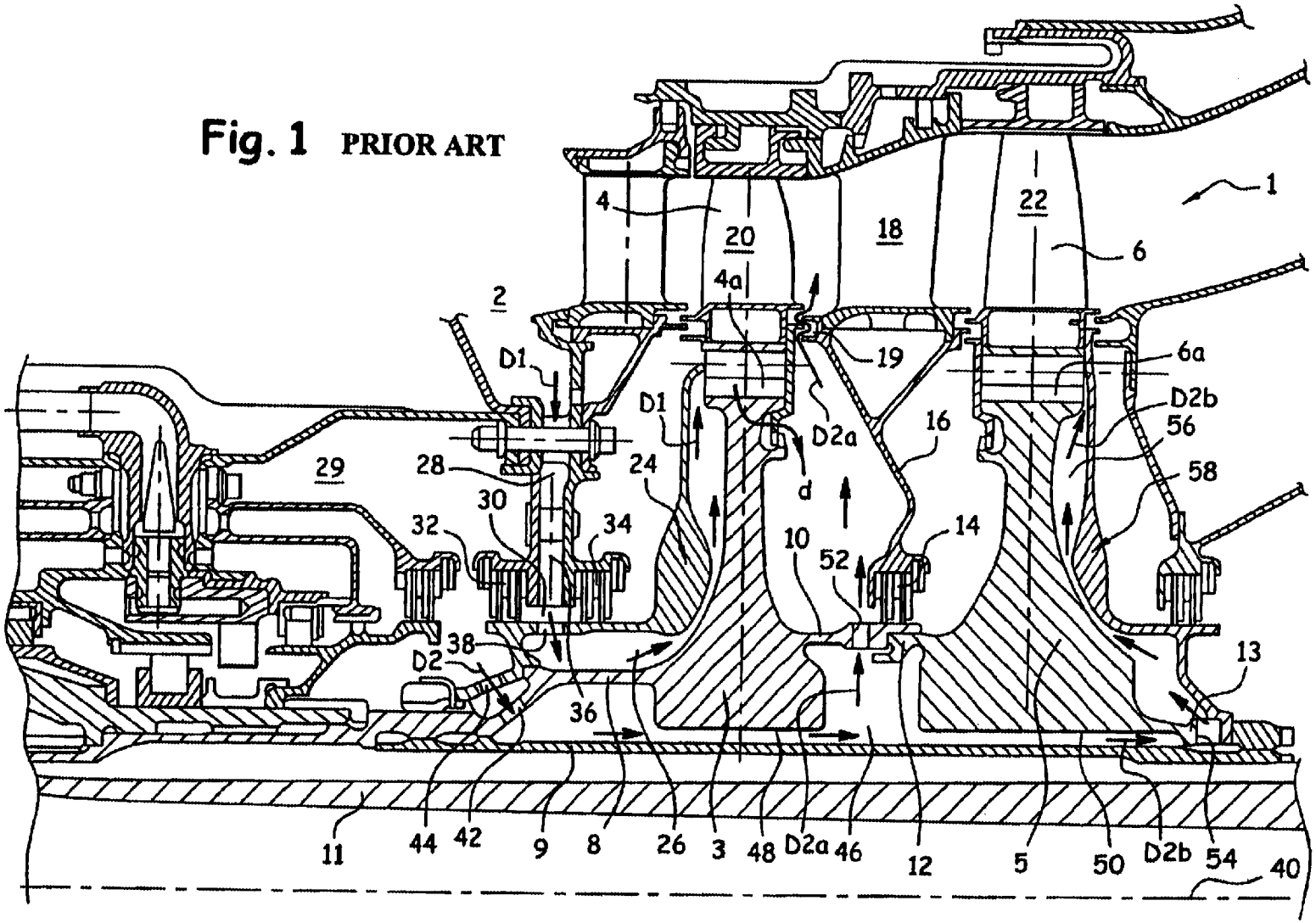
Fig. 1 PRIOR ART
FIG. 1, already described, shows a half section through a high pressure turbine of a turbojet according to prior art, and, FIG. 2 shows a half section through a high pressure turbine of a turbojet comprising a ventilation device according to a preferred embodiment of this invention.
Figure 2:
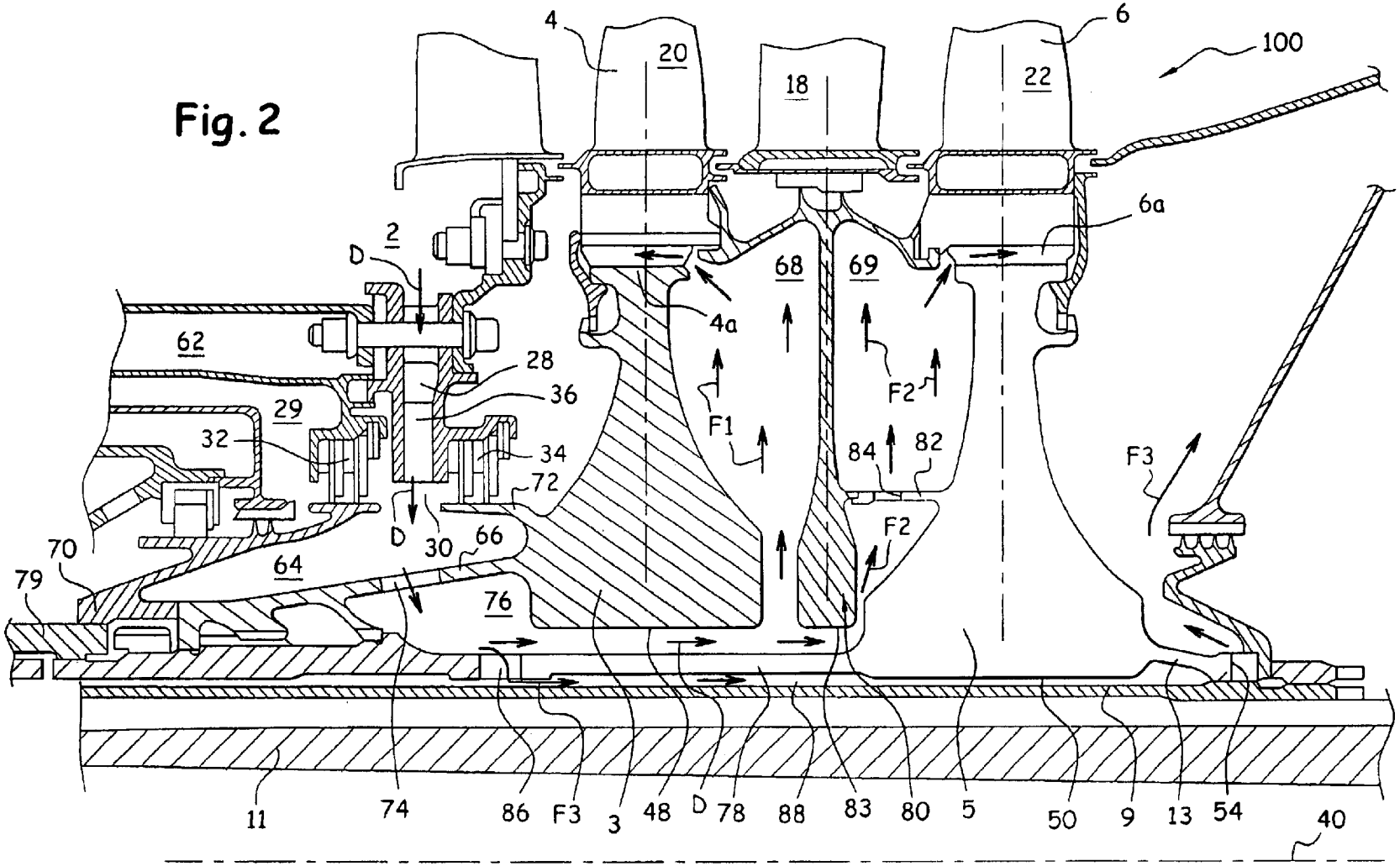

FIG. 2 shows a high pressure turbine 100 of a turbojet, comprising a ventilation device for the turbine rotor according to a preferred embodiment of this invention. Note in FIG. 2, that elements with the same numeric references as elements shown in FIG. 1 correspond to identical or similar elements.

Thus, FIG. 2 shows a turbine 100 that is different from the turbine 1 according to prior art firstly due to the fact that a cooling airflow D taken from the back of the combustion chamber 2 and that can pass through injectors 36, will supply blades 4 and 6 of the upstream disk 3 and downstream disk 5 simultaneously.

In fact, the cooling airflow from the combustion chamber 2 passes through the duct 28 to reach the injectors 36, this assembly composed of the duct 28 and the injectors 36 being located in a chamber 62 separating the upstream disk 3 from, the back of the combustion chamber 2.

The cooling airflow D originating from the injectors 36 then penetrates into a cavity 64 partially delimited by an upstream flange 66 of the upstream turbine disk 3, the main function of this upstream flange 66 being to attach this upstream disk 3 onto an upstream flange 78 of the downstream disk 5. Furthermore, this cavity 64 is also delimited jointly by the upstream seal 32 and the downstream seal 34, preferably of the labyrinth seal type, located close to injectors 36 on the upstream and downstream sides of the seal respectively. In this respect, note that the upstream seal 32 cooperates with a downstream flange 70 in the high pressure turbine, this downstream flange 70 being-arranged to be radially on the outside of the upstream flange 66. Furthermore, the upstream seal 32 closes the cavity 64, matching the upstream end of the upstream flange 66. Furthermore, the downstream seal 34 cooperates with a secondary upstream flange 72 of the upstream turbine disk 3, arranged to be located radially on the outside of the upstream flange 66. Thus, the cooling air escaping from the cavity 64 through the downstream seal 34 can circulate radially outwards, along the upstream face of the upstream disk 3, towards the blades 4.

Orifices 74 are provided in the upstream flange 66 of the upstream turbine disk 3, so that the cooling airflow D can be guided towards the two turbine disks 3 and 5. The orifices 74 are preferably arranged to be located facing the injectors 36 in the radial direction.

After passing through the orifices 74, the cooling airflow D penetrates into an annular chamber 76 with axis 40, delimited on the outside through the upstream flange 66 of the upstream disk 3, and by the inner reaming 48 of this same disk. Furthermore, the annular chamber 76 is delimited on the inside by the upstream flange 78 of the downstream disk 5, this upstream flange 78 having the main function of fixing this downstream disk 5 on the upstream flange 66 of the upstream disk 3, and centering the high pressure turbine assembly 100 on a downstream flange 79 of a high pressure compressor.

The cooling airflow D can then circulate axially in the downstream direction between the inner reaming 48 and the upstream flange 78, such that the upstream turbine disk 3 can be satisfactorily cooled by contact of cooling air with its inner reaming 48.

As can be seen in FIG. 2, the ventilation device according to the invention comprises a single labyrinth 80 inserted between the turbine disks 3 and 5, and is fixed to one of these two disks. As a non-limitative example, the single labyrinth 80 (also called the inter-disk labyrinth) is fixed to a secondary upstream flange 82 of the downstream turbine disk 5, which is arranged so that it is radially on the outside of the upstream flange 78. Furthermore, the labyrinth 80 extends in the radial direction until it matches the fixed distributor stage 18 or the stator provided between the two rotor stages 20 and 22, and is provided with an inner reaming 83 surrounding the upstream flange 78 of the disk 5, this reaming 83 preferably having a diameter substantially identical to the diameter of the inner reaming 48 of the disk 3.

Consequently, the cooling airflow D passing through the annular chamber 76 and reaching the downstream face of the upstream disk 3, separates into two flows F1 and F2 that will supply blades 4 on disk 3 and blades 6 on disk 5, respectively.

Therefore, the first flow F1 circulates in a cavity 68 located between the downstream face of the upstream turbine disk 3 and the upstream face of the labyrinth 80 in order to cool the downstream face of disk 3, and then enters the compartments 4*a* containing the roots of blades 4 in order to cool these blades.

Similarly, the second flow F2 circulates in a cavity 69 located between the upstream face of the downstream turbine disk 5 and the downstream face of the same labyrinth 80 in order to cool the upstream face of disk 5 and then penetrates into compartments 6*a* containing the roots of blades 6 in order to cool these blades as well. Note that several orifices 84 are formed in the secondary upstream flange 82 of the downstream disk 5, so that the second flow F2 can reach the blades 6 of the downstream turbine disk 5.

Consequently, the ventilation device according to the invention is such that the cooling airflow D taken from the back of the combustion chamber 2 and that will be used to supply blades 4 and 6 simultaneously, follows a single cooling circuit as far as the exit from the passage between the reaming 48 of the upstream disk 3 and the upstream flange 78 of the downstream turbine disk 5. This specific characteristic considerably simplifies the design of the turbine 100 compared with the design of the turbine 1 according to prior art, in which two cooling airflows were taken from the back of the combustion chamber 2, to follow two completely separate cooling circuits.

Moreover, the upstream flange 78 of the downstream turbine disk 5 contains several orifices 86 through which a third flow F3 of the cooling airflow D can pass. This third flow F3 is therefore routed from the annular chamber 76 towards an annular space 88 with the same axis, the space. 88 being located between firstly the upstream flange 78 of the downstream disk 5 and the inner reaming 50 of this same downstream disk 5, and secondly the spacer 9 located around the shaft 11 of the rotor of the low pressure turbine. Thus, the cooling airflow F3 can circulate axially in the annular space 88 in the downstream direction, in order to cool the downstream disk 5 by contact of air with its inner reaming 50. The third flow F3 is then evacuated-on the downstream side of the turbine 100 through orifices 54 formed on the downstream flange 13 of the downstream turbine disk 5, this downstream flange 13 also participating in the outer delimitation of the annular space 88 and being assembled on the spacer 9 of the shaft 40.

It is to be understood that a person skilled in the subject could make various modifications to the turbine 100 and its ventilation device that have just been described above solely as non-limitative examples.

What is claimed is:

1. Ventilation device for a high pressure turbine rotor of a turbomachine, the turbine rotor being arranged on the downstream part of a combustion chamber and comprising an upstream turbine disk fitted with blades and a downstream turbine disk fitted with blades, said device comprising a cooling circuit fitted with injectors on the upstream side of the upstream disk and supplied with a cooling airflow D taken from the back of the combustion chamber, wherein said cooling circuit is arranged such that the cooling airflow D originating from the injectors passes through orifices formed in an upstream flange of the upstream disk so that the upstream flange of the upstream disk can be fixed on an upstream flange of the downstream disk, so that this cooling airflow D circulates in the axial downstream direction between an inner reaming in the upstream disk and the upstream flange of the downstream disk so that the upstream flange of the downstream disk can be fixed on a downstream flange of a high pressure compressor and so that the upstream disk can be centered, said ventilation device also comprising a single labyrinth fixed to one of the two turbine disks and being inserted between these two disks, such that the cooling airflow D is divided into a first flow F1 circulating between a downstream face of the upstream disk and an upstream face of the single labyrinth towards the blades of the upstream disk, and into second flow F2 circulating between an upstream face of the downstream disk and a downstream face of the single labyrinth towards the blades of the downstream disk.

2. Device according to claim 1, wherein the injectors penetrate into a cavity partially delimited by the upstream flange of the upstream turbine disk, and by an upstream seal and a downstream seal, this downstream seal cooperating with a secondary upstream flange of the upstream turbine disk.

3. Device according to claim 1 or to claim 2, wherein several orifices are formed in the upstream flange of the downstream turbine disk, so that a third flow F3 of the cooling airflow D can pass through the orifices, said third flow F3 circulating in the downstream axial direction within an annular space formed between firstly the upstream flange of the downstream disk and an inner reaming of this downstream disk, and secondly a spacer located around a rotor shaft of a low pressure turbine.

4. Device according to claim 1 or claim 2, wherein the single labyrinth is fixed to a secondary upstream flange of the downstream turbine disk, in which several orifices are formed through which the second flow F2 of the cooling airflow D can circulate towards the blades of the downstream disk.

* * * * *